United States Patent [19]

Straubel et al.

[11] 4,300,515

[45] Nov. 17, 1981

[54] APPARATUS FOR ACTUATING AN ADJUSTMENT DEVICE ACTING UPON A CONTROL APPARATUS FOR EXHAUST RECIRCULATION IN INTERNAL COMBUSTION ENGINES

[75] Inventors: Max Straubel; Gerhard Stumpp, both of Stuttgart; Klaus Krieger, Affalterbach; Wolf Wessel, Oberriexingen, all of Fed. Rep. of Germany

[73] Assignee: Robert Bosch GmbH, Stuttgart, Fed. Rep. of Germany

[21] Appl. No.: 96,072

[22] Filed: Nov. 20, 1979

[30] Foreign Application Priority Data

Dec. 20, 1978 [DE] Fed. Rep. of Germany ..... 2855027

[51] Int. Cl.[3] ..... F07M 25/06

[52] U.S. Cl. ..... 123/568; 173/569

[58] Field of Search ..... 123/569, 568

[56] References Cited

FOREIGN PATENT DOCUMENTS

| | | | |
|---|---|---|---|
| 1802315 | 6/1970 | Fed. Rep. of Germany | 123/569 |
| 1963235 | 6/1971 | Fed. Rep. of Germany | 123/569 |
| 1964140 | 6/1971 | Fed. Rep. of Germany | 123/569 |
| 2658052 | 6/1978 | Fed. Rep. of Germany | 123/569 |

*Primary Examiner*—Wendell E. Burns
*Attorney, Agent, or Firm*—Edwin E. Greigg

[57] ABSTRACT

An apparatus is proposed which serves the purpose of load-dependent actuation of an adjustment device, wherein the cross section and/or the pressure drop of an exhaust recirculation line in an internal combustion engine can be varied in accordance with load. An injection pump of conventional design is associated with the internal combustion engine and further includes a quantity adjustment device, the position of which acts as a control variable for the load. With this control variable, a booster apparatus is controlled via a comparison apparatus; the output variable of the booster apparatus in turn is the control variable for the actuation of an adjustment device which acts on an exhaust recirculation control apparatus. When a threshold value for load is exceeded, the exhaust recirculation is precluded. The control variable is preferably formed as a fuel pressure signal with the fuel withdrawn from the suction chamber of the injection pump. Apparatuses are proposed by means of which, in the event of the actuation of the control apparatus for exhaust recirculation, the smallest possible removal quantity of fuel is required for control purposes.

6 Claims, 6 Drawing Figures

FIG. 5
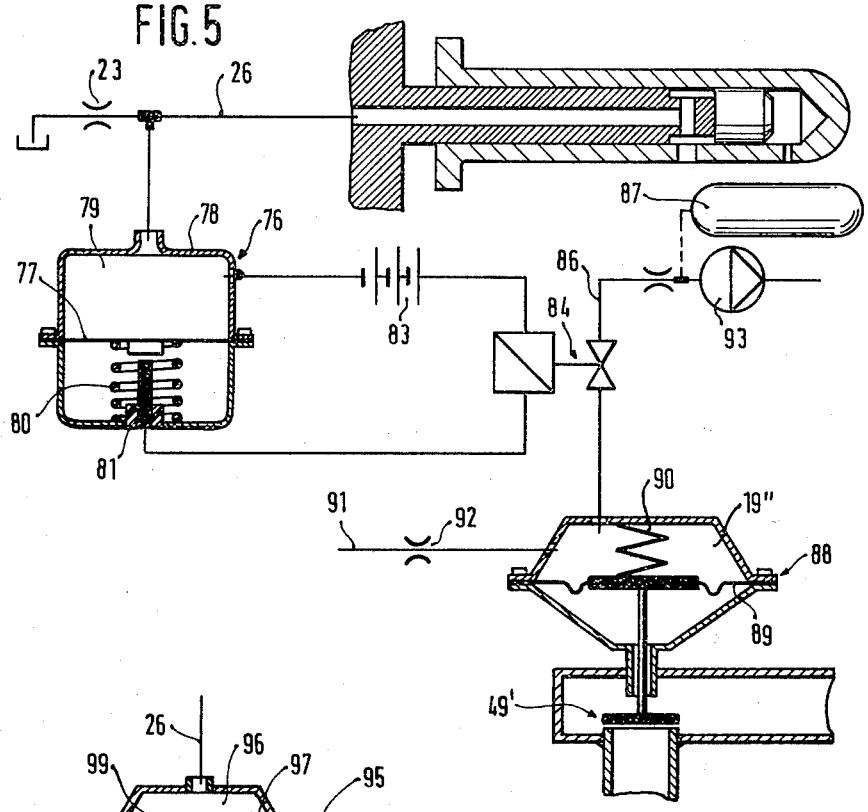
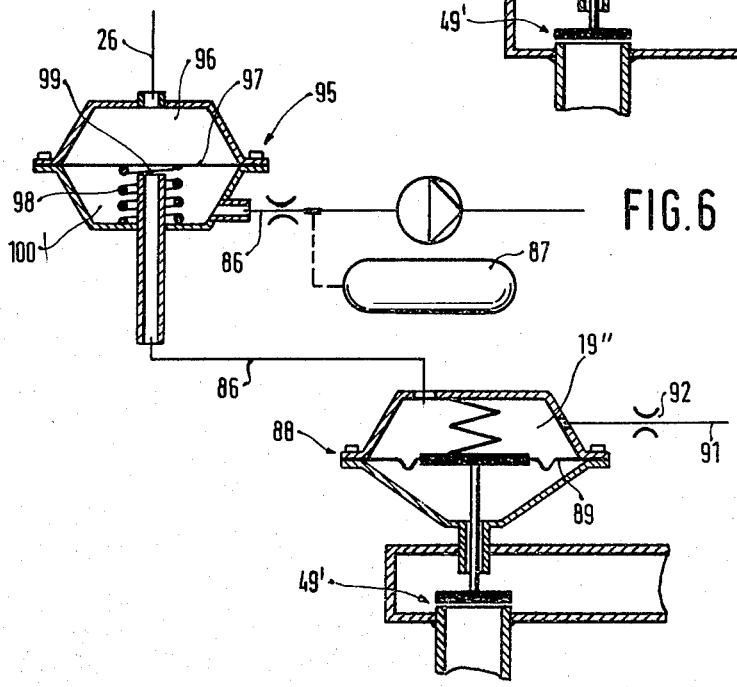
FIG. 6

APPARATUS FOR ACTUATING AN ADJUSTMENT DEVICE ACTING UPON A CONTROL APPARATUS FOR EXHAUST RECIRCULATION IN INTERNAL COMBUSTION ENGINES

BACKGROUND OF THE INVENTION

The invention relates to an apparatus in accordance with the invention described herein and finally claimed. In a known apparatus of this type, a signal analogous to load is generated and, through a load-dependent variation of a cross section in a pressure fluid supply line, for instance, a variable adjustment pressure which arises at an outlet throttle is made available, the amount of this pressure being correspondent to the load set at the fuel injection pump. However, this apparatus has the disadvantage that in order to provide precise metering of recirculated exhaust gas quantities, appropriate to the particular family of characteristic curves, high costs must be borne for the measurement of passage cross sections and their association with the particular load points required.

OBJECTS AND SUMMARY OF THE INVENTION

The apparatus in accordance with the invention has the advantage over the prior art in that the control apparatus for exhaust recirculation essentially assumes only two positions, that is, either fully closed or fully opened, and does so when a certain load or a certain fuel injection quantity, which characterizes a certain high partial-load level or the circumstances of starting, is exceeded. The measurement of the passage cross sections, in this case, can be performed at substantially lower cost. For internal combustion engines which require a small exhaust recirculation quantity in order to meet legal requirements for exhaust composition, an apparatus of this kind is sufficient.

Also, the recirculation of controlled exhaust quantities to the intake manifold of an internal combustion engine has proved to be an effective means of reducing the proportion of toxic substances in the exhaust gases of the engine. In particular, in auto-igniting engines, the high $NO_x$ component can be reduced. Despite the availability of known and expensive control apparatuses for the recirculation of exhaust gas, there is still a need for making such apparatuses as simple and as functionally reliable as possible. The achievement of the simplest and most cost-favorable possible control of the quantity of recirculated exhaust which is still sufficiently effective is particularly important in smaller vehicles. It has proved to be particularly suitable to make an adjustment which, at high fuel injection quantities such as in full-load operation or in the case of enrichment during starting, interrupts the recirculation of the exhaust so that there is no reduction of output from exhaust recirculation in these critical phases in which maximum output is required of the engine. In the other operational phases, with an appropriately adapted average exhaust recirculation quantity, a generally good result can be attained in the exhaust gas composition.

Advantageous further embodiments and improvements of the apparatus disclosed are possible by means of the features set forth herein. In one embodiment, the removal of a scavenging quantity of fuel from the injection pump, which otherwise takes place, is shut off in an advantageous manner during the actuation of the control apparatus for exhaust recirculation. This scavenging quantity is advantageously put to use for the adjustment of required fuel quantities, so that the fuel pressure in the suction chamber of the injection pump, which may, for instance, be regulated for other control purposes as well, is not affected by the actuation of the control apparatus for exhaust recirculation.

The invention will be better understood, and further objects and advantages thereof will become more apparent from the ensuing detailed description of preferred embodiments taken in conjunction with the drawings.

BRIEF DESCRIPTION OF THE DRAWINGS

FIG. 5 shows schematically a fourth exemplary embodiment of this invention that includes a control means for the delivery of an adjustment fluid from a second pressure source which is independent of the fuel injection pump; and FIG. 6 shows schematically a fifth exemplary embodiment of this invention that includes a control means, that is a modification of that shown in FIG. 5, for the delivery of an adjustment fluid from a second pressure source.

DESCRIPTION OF THE PREFERRED EMBODIMENTS

Figure 1:
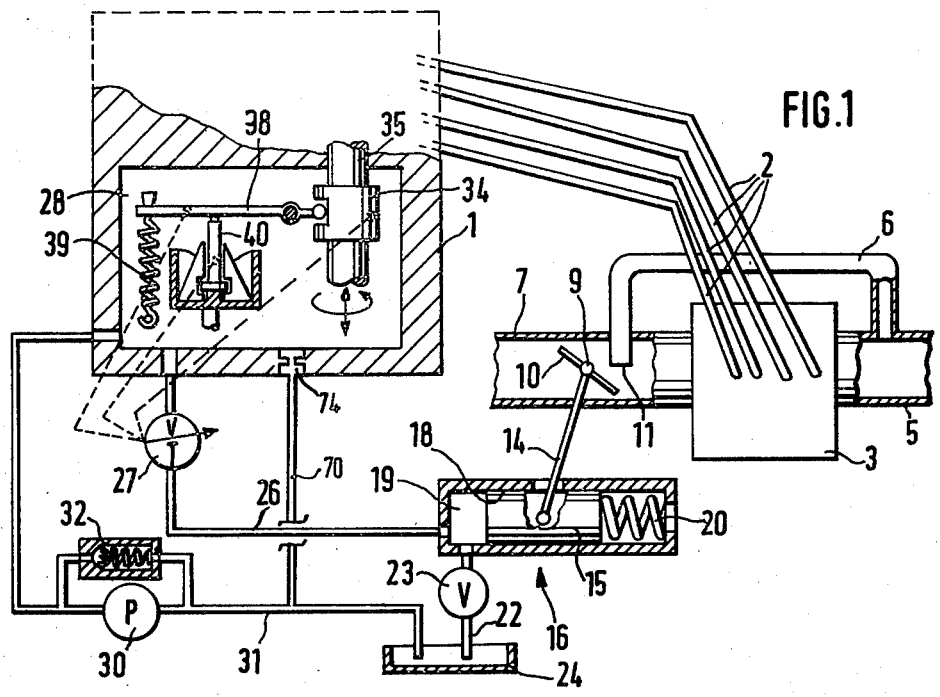
FIG. 1 is a schematic illustration of a first exemplary embodiment of the invention.

Turning now to the drawings, in FIG. 1 a fuel injection pump 1 is shown schematically, which supplies fuel over lines 2 to an internal combustion engine 3. An exhaust recirculation line 6 leads from the exhaust manifold 5 of the engine, which is illustrated only schematically, to the intake manifold 7 downstream of the shaft 9 of a throttle valve 10 that is disposed in the intake manifold. The exit opening 11 of the exhaust recirculation line 6 is controllable with the portion of the throttle valve 10 located downstream of the shaft 9 and is closed thereby at full load. Thus, the exhaust recirculation control apparatus so embodied by the position of the throttle valve, affects both the cross section of the exit opening 11 and the pressure drop at this opening. The shaft 9 of the throttle valve is mechanically connected via a rod 14 with an adjusting device 15 of a servomotor 16. The adjusting device 15 is embodied as a piston and encloses a work chamber 19 within a closed cylinder 18 and is subjected on the opposite side to the force of a return spring 20. The work chamber 19 communicates with a fuel container 24 via a relief line 22, in which an adjustable throttle 23 is disposed. There is a further connection between the work chamber 19 and the chamber 28 of the fuel injection pump, which may also be called the suction chamber and is filled with fuel and under pressure, this connection being provided by a control line 26, whose cross section is controllable by a valve 27.

The suction chamber 28 of the fuel injection pump is supplied with fuel with the aid of a fuel supply pump 30 via a fuel supply line 31 from the fuel container 24. A pressure regulating valve 32 is switched parallel to the fuel supply pump 30. In this case, the fuel injection pump is a distributor-type injection pump of a known design, in which the effective supply stroke of the pump 35 is determined by the position of the control slide 34 which functions as the quantity adjustment device. In accordance with the structural principle of this distributor injection pump, the pump piston performs a reciprocating and simultaneously rotating movement, as is indicated by arrows. The adjustment of the control slide 34 occurs in a known manner by means of a lever 38 supported in the middle, which is connected at one end with the control slide 34 and on the other end is subjected to the force of at least one control spring 39 of adjustable initial tension. The governor sleeve 40 of a centrifugal governor 42 (see FIG. 2) engages the lever 38 in a known manner, against the force of this spring 39. The control sleeve 40 is adjustable by means of flyweights 41, which are driven to rotate in proportion to the rotational speed of the pump. Depending on the initial tension of the control spring 39, the governor sleeve 49 is displaced to a greater or lesser extent at a certain rpm, so that the control slide 34 as well assures a higher or lower position relative to the pump piston 35. The position of the governor sleeve 40 as well as of the lever 38 and of the control slide 34 represent a standard for the set fuel supply quantity or for the load.

Figure 2:
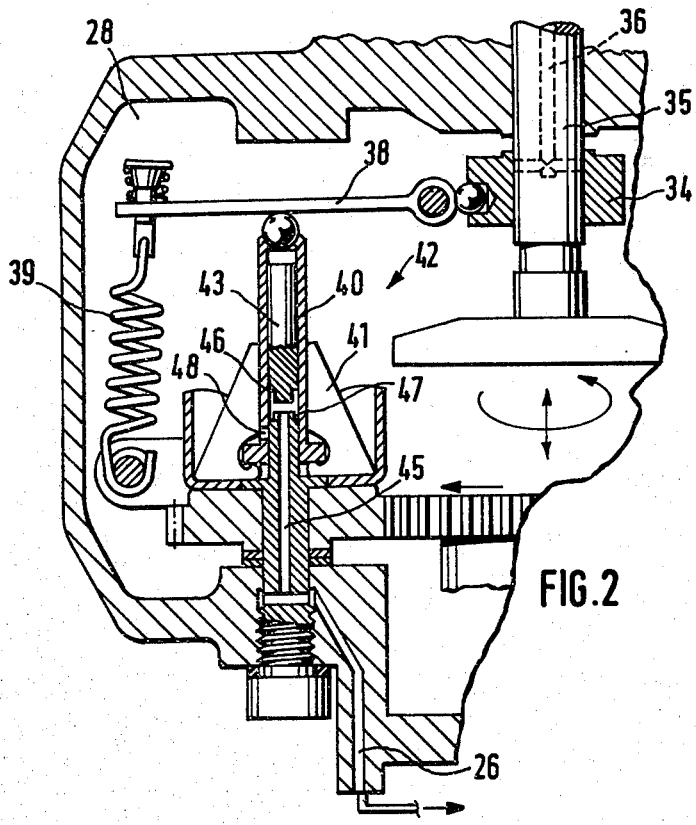
FIG. 2 is a partial section through a fuel injection pump with a device for generating a control variable, upon exceeding a certain load point.

As is indicated by broken lines in FIG. 1, the cross section of the valve 27 can be adjusted in accordance with load depending on the position of the control slide 34, the lever 38 or the governor sleeve 40. Such an adjustment can be performed either by mechanical or by electrical means without retroactive effect. An advantageous embodiment for generating a mechanical control variable which has no retroactive effect is shown in FIG. 2. There the carrier 43, on which the governor sleeve 40 is displaceable by means of the flyweights 41, has an axial bore 45, which discharges into an external annular groove 46 that is provided in the carrier 43. The annular surface of the external annular groove 46 thereby forms a first, stationary, passage opening 47 of the valve 27. The axial bore 45 is part of the control line 26. In the wall of the governor sleeve 40, a second passage opening 48, this one adjustable together with the governor sleeve 40, is provided, which forms the other part of the valve 27. Through the displacement of the governor sleeve 40, the second passage opening 48 can be made to overlap the first passage opening 47, so that beyond a certain axial displacement of the governor sleeve 40, a connection can be furnished from the suction chamber 28 to the work chamber 19 via the control line 26.

The apparatus described above may be conceived of as a comparison apparatus, wherein the first, stationary passage opening 47 (that is, the annular groove 46) represents a comparison or threshold value as a standard for a certain minimum load or minimum fuel injection quantity. Only when the second passage opening 48 is made to overlap the first passage opening 47 does this comparison apparatus produce a signal, in the form of a fuel flow which passes through both passage openings and this signal is conveyed to the work chamber 19. A work pressure then builds up at the throttle 23 in the work chamber 19, which displaces the adjusting device 15 and puts the throttle valve 10 into the closed position with respect to the exhaust recirculation line.

The process described above may equally well be attained by mechanical-electrical means, such as by means of a pair of contacts, of which the first contact is stationary and characterizes a certain load and the other contact represents the actual load at that particular time. Upon the attainment of the set minimum load, an electrical circuit is closed via the contacts, which actuates an adjusting device in such a manner that the recirculation of exhaust is precluded. The adjusting device may be an electromotor or a magnet.

Beyond a certain settable load, the recirculation of exhaust can be precluded in the manner described above, so that during full-load operation the combustion chambers of the engine can be supplied with the maximum possible charge. Also, when there is an increased fuel delivery during starting, no recirculation of exhaust gases occurs, which would impair the starting of a cold engine.

Figure 3:
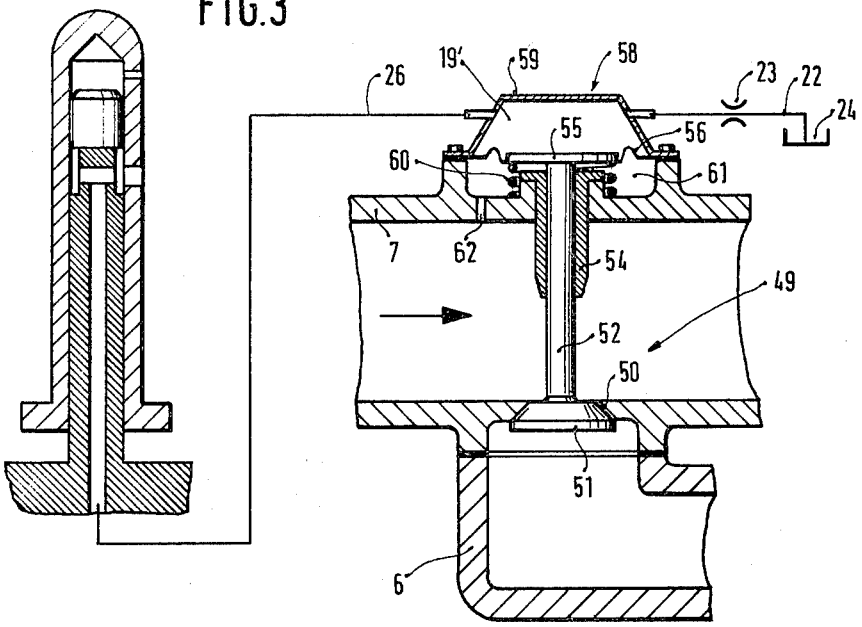
FIG. 3 shows schematically a second exemplary embodiment of this invention having a valve plate in the cross section of an exhaust recirculation line and arranged to be actuated by a hydraulic servomotor.

FIG. 3 shows a different embodiment of the control apparatus for exhaust recirculation having an exhaust recirculation valve 49, which is driven in the same manner as that revealed in the exemplary embodiment of FIGS. 1 and 2. Here, the discharge of the exhaust recirculation line 6 into the intake manifold 7 is shown. The entry opening 50 in the intake manifold 7 is here controlled by a valve plate 51, the valve shaft 52 of which is slidably positioned within a valve guide 54 placed on the opposite side from the entry opening 50 and thus projects into the intake manifold 7. On an end which protrudes out of the intake manifold 7, the valve shaft 52 is connected with a holder plate 55 for an adjustment diaphragm 56, which is the adjusting device of a hydraulic servomotor 58. The work chamber 19' is enclosed by the adjustment diaphragm 56 in the housing 59 of this servomotor 58, and the control line 26 discharges into this work chamber 19' and leads out of the relief line 22 containing the throttle 23 and into the fuel supply container 24. The adjustment diaphragm 56 is urged via the holder plate 55 by a compression spring 60 in such a manner that it brings the valve shaft 52 and the valve plate 51 into a position which closes the entry opening 50. The chamber between the adjustment diaphragm 56 and the intake manifold 7 containing the compression spring 60 is connected by a bore 62 with the intake manifold 7 for the purpose of pressure equalization.

This embodiment of the exhaust recirculation control apparatus has the advantage that the closing movement of the valve plate 51 is reinforced by the pressure of the exhaust. The described embodiment of the hydraulic servomotor has the advantage that no fuel can leak into the intake manifold of the engine. This is substantially effected by the use of the adjustment diaphragm 56, which tightly seals the work chamber 19' independently of the position of the valve plate 51.

As soon as fuel is conveyed over the control line 26 into the work chamber 19', pressure builds up through the retroactive effect of the throttle 23 and displaces the adjustment diaphragm 56 against the force of the compression spring 60 and lifts the valve plate 51 from its seat at the entry opening. If the passage openings 47 and 48 are closed, then the work chamber 19' is relieved via the throttle 23 and the relief line 22, so that the valve plate 51 can move back into its closed position. The speed of adjustment on the part of the valve can be set with the aid of the throttle 23.

Figure 4:
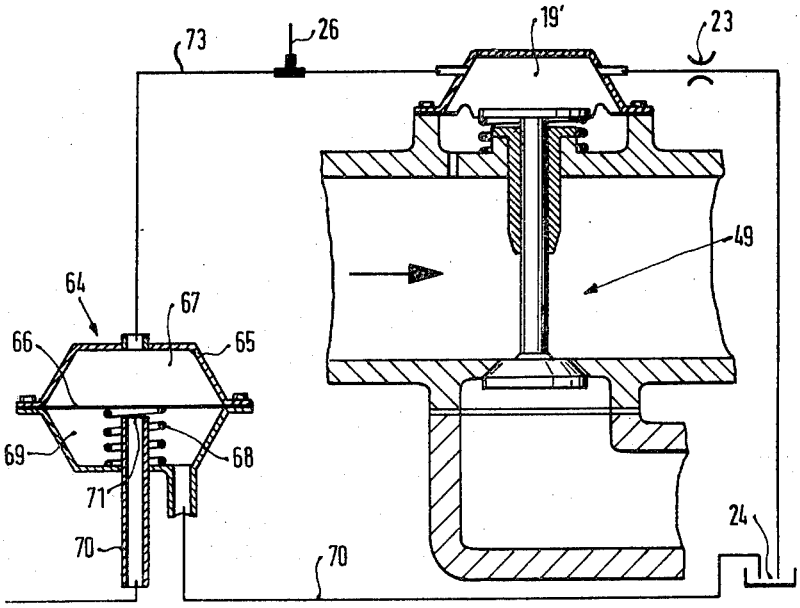
FIG. 4 shows schematically a third exemplary embodiment of this invention with a device for interrupting the discharge of scavenging fuel from the suction chamber of a fuel injection pump of the type shown in FIG. 2 upon the actuation of an exhaust recirculation control apparatus.

FIG. 4 shows a supplementary embodiment to that concept shown in FIG. 3. Here, an exhaust recirculation valve 49 is provided which is identical to that shown in FIG. 3. However, in deviation from the embodiment of FIG. 3, a pressure switch 64 is provided which comprises a diaphragm 66 firmly held within the pressure switch housing 65 which tightly encloses a pressure chamber 67 in the housing 65 and separates it from a second chamber 69, in which a compression spring 68 is disposed between the diaphragm 66 and the housing 65. A second relief line 70 protrudes into the chamber 69 at right angles to the diaphragm 66, which upon a deflection against the force of the compression spring 68 can close the entry opening 71 of the second relief line 70. The chamber 69 is further connected with the second portion, which cannot be closed, of the second relief line 70 which leads to the fuel supply container 24. In contrast, the pressure chamber 67 communicates via a branch line 73 with the control line 26.

The second relief line 70, as may be inferred from FIG. 1, leads from the suction chamber 28 to the fuel supply container 24 and this relief line, as shown in FIG. 1, contains a scavenging throttle 74 at the point where the line exits from the suction chamber 28. When the relief line 70 is not closed, this scavenging throttle 74 determines the quantity of scavenging fuel flowing out of the suction chamber 28. This scavenging is used in a conventional manner for the purpose of thermal relief and for degassing of fuel injection pumps.

The apparatus of FIG. 4 functions in the following manner: When the passage openings 47 and 48 are made to overlap, that is, when fuel flows through the control line 26 to the work chamber 19' of the hydraulic servomotor, this fuel also enters the pressure chamber 67, in which the pressure which builds up at the throttle 23 is then established. Under the effect of this pressure, the diaphragm 66 is deflected and closes the entry opening 71 of the second relief line 70 and thus prevents the scavenging fuel quantity from flowing out through the relief line 70 to the fuel supply container 24. That is, in this embodiment of the invention the scavenging quantity which is otherwise conventional is advantageously replaced by the fuel quantity which flows through the throttle 23 into the fuel supply container 24 and performs the same function. Then, in an advantageous manner, a quantity of fuel which is constant, given a controlled internal pressure in the suction chamber 28, flows out via one of the throttles 23 or 74, so that the controlled pressure in the suction chamber, which serves the purpose of injection adjustment, for instance, is not disturbed upon the actuation of the exhaust recirculation apparatus.

FIG. 5 shows a further modification of the invention in which only a very small fuel discharge quantity is necessary for the actuation of the exhaust recirculation valve. In the same manner as in the foregoing exemplary embodiments, a control pressure is established in the control pressure line 26 by throttling the fuel flowing through the passage openings 47 and 48, which now overlap, at the throttle 23. These numerals are shown in FIGS. 1 and 2. Deviating from the exemplary embodiments of the invention shown in FIGS. 3 and 4, a pressure switch generally denoted as 76 is provided which has a switching diaphragm 77, which encloses a pressure chamber 79 in the housing 78 of the pressure switch 76. The control line 26 discharges into this pressure chamber 79. The switching diaphragm 77 is subjected to the force of a compression spring 80 from the side opposite the pressure chamber 79. On this side there is also a contact 81 that is insulated with respect to the housing 78; the switching diaphragm 77 is made to touch this contact 81 when it is deflected against the force of the spring 80. The switching diaphragm is electrically conductive and connected with one pole of a voltage source 83, while the other pole of the voltage source leads to the contact 81. Furthermore, the magnetic coil of a magnetic valve 84 is included in the connecting line between the voltage source 83 and the contact 81.

The magnetic valve is located in a supply line 86 for the adjustment medium which leads from a pressure source 87 into the work chamber 19'' of a pressure-actuated servomotor 88. This servomotor 88 is equipped, as a diaphragm-type servomotor, with an adjustment diaphragm 89 tightly enclosing the work chamber 19'' and thus functions as the actuation device for the exhaust gas recirculation valve 49''. In a development which varies from the foregoing exemplary embodiments of this invention, the servomotor is adapted in such a way that it is actuatable by underpressure. To this end, a compression spring 90 is disposed in the work chamber 19'' which urges the adjustment diaphragm 89 into a displacement direction which closes the exhaust recirculation valve 49'. Here, as well, in order to relieve the work chamber 19'', a relief line 91 containing a throttle 92 is provided. The underpressure source may be realized in the form of an underpressure supply container or in the form of a suction pump 93.

The apparatus functions in the following manner:

As soon as a pressure is established at the throttle 23 as a result of inflowing fuel—which pressure also becomes effective in the pressure chamber 79—the switching diaphragm 77 is arranged to touch the contact 81 and the electrical circuit is then closed. The magnetic valve 84 thereby becomes attractive and establishes the connection between the pressure source 87 and the work chamber 19''. As a result of the underpressure being established there, the adjustment diaphragm 89 is deflected against the force of the spring 90 and the exhaust recirculation valve 49' is opened. If the pressure in the control line 26 drops, then the electrical circuit is opened and the supply line 86 for the adjustment medium is closed by the magnetic valve 84. The exhaust recirculation valve 49' accordingly closes after pressure equalization via the throttle 92.

As a result of this embodiment of the invention, only a very small quantity of fuel is required for actuating the pressure switch 76, so that the pressure in the suction chamber 28 of the fuel injection pump is not substantially disturbed in the event of the necessary actuation of the exhaust recirculation apparatus. In an advantageous manner, a pressure source which is already available in the vehicle driven by the internal combustion engine can be used for the actuation of the exhaust recirculation apparatus. This may be, for example, the use of the intake manifold underpressure. However, it is also possible, given the availability of a compressed-air brake system, to use the brake supply pressure for the actuation of an appropriately modified exhaust recirculation valve.

FIG. 6 shows a modified form of still another embodiment of this invention in which, again, the quantity of fuel flowing out of the suction chamber of the injection pump is used as the control means for a switching valve when the passage openings 47 and 48 (see FIG. 2) overlap; as a result, an auxiliary energy source can be connected with a servomotor for the exhaust recirculation valve. The form of embodiment shown functions in the same manner as the embodiment of FIG. 5, with underpressure as the adjustment medium. To this extent, the two embodiments are quite similar. However, instead of a magnetic valve 84, a pressure switch 95 is used here in the supply line 86 for the adjustment medium and the pressure switch 95 has an adjustment diaphragm 97 tightly enclosing a pressure chamber 96 in the housing. On the other side, the adjustment diaphragm 97 encloses a fuel-filled chamber 100, in which a compression spring 98 engaging the adjustment diaphragm 97 is disposed and into which one portion of the supply line 86 for the adjustment medium discharges in the form of a nozzle in such a fashion that its discharge portion 99 lies opposite the adjustment diaphragm 97 and acts as the valve closing element therefor. The supply line 86 for the adjustment medium leads, in a manner preventing its closure, from the chamber 100 to the pressure source 87.

The pressure chamber 96 is connected with the control pressure line 26, so that upon an increase in pressure in the control pressure line 26 the adjustment diaphragm 97 is deflected against the force of the spring 98 and the passage opening 99 of the supply line 86 for the adjustment medium is closed. Then, as in the preceding example, after a pressure relief of the work chamber 19'', the exhaust recirculation valve 49' is closed. In this exemplary embodiment, in an advantageous manner, no electrical switching means are necessary. Also, only a small quantity of fuel needs to be withdrawn from the interior of the fuel injection pump for control purposes in order to effect the rapid actuation of the exhaust recirculation apparatus, so that the controlled pressure in the suction chamber of the fuel injection pump is not disturbed. This pressure acts, for example, to actuate the injection timing adjustment. In an advantageous manner, and in contrast to the embodiment of FIGS. 1-4, the fuel in this embodiment of the invention is kept away from the exhaust recirculation valve, which heats up severely during operation.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for load-dependent actuation of an exhaust recirculation adjustment device in an internal combustion engine comprising a fuel injection pump, said fuel injection pump including a fuel supply chamber, a threshold comparison apparatus within said fuel supply chamber and a fuel quantity adjustment device adjustable in accordance with load, said threshold comparison apparatus including means defining plural passages, a first of said passages being stationary and a second of said passages being adjustable in accordance with the actuation of said fuel quantity adjustment device, said exhaust recirculation adjustment device including a valve for controlling exhaust gases from an exhaust manifold to an intake manifold and a hydraulic servomotor including an adjustment device connected to said valve for adjusting said valve, a pressure control line connected between said hydraulic servomotor and said first passage of said threshold comparison apparatus wherein the alignment of said first and second passages provides for a discharge of fuel under pressure from said fuel supply chamber of said injection pump into said control line and the flow of fuel out of the fuel supply chamber acts as a control variable for the actuation of said exhaust recirculation adjustment device; and a first relief line including an adjustable throttle connected between said hydraulic servomotor and a fuel supply; further wherein said fuel injection pump includes a second relief line connected thereto which extends away from said fuel supply chamber, said second relief line containing a scavenging throttle which is thereby capable of adjusting a scavenging fuel quantity, a pressure switch connected with said control line and said second relief line, said pressure switch arranged to control fluid flow through said second relief line.

2. An apparatus for load-dependent actuation of an exhaust recirculation adjustment device in an internal combustion engine comprising a fuel injection pump, said fuel injection pump including a fuel supply chamber, a threshold comparison apparatus within said fuel supply chamber and a fuel quantity adjustment device adjustable in accordance with load, said threshold comparison apparatus including means defining plural passages, a first of said passages being stationary and a second of said passages being adjustable in accordance with the actuation of said fuel quantity adjustment device, said exhaust recirculation adjustment device including a valve for controlling exhaust gases from an exhaust manifold to an intake manifold and a diaphragm-type servomotor including an adjustment device for adjusting said valve, a pressure medium connected with said servomotor for operating said valve, a pressure switch for controlling flow of said pressure medium to said servomotor and a control line connected between said first passage of said threshold comparison apparatus and said pressure switch for operating said pressure switch whereby said pressure switch controls said pressure medium to said servomotor for activation of said exhaust recirculation adjustment device.

3. An apparatus in accordance with claim 1, further wherein said pressure switch has a spring loaded diaphragm arranged to enclose a pressure chamber in communication with said control line, said diaphragm adapted to close said relief line upon exceeding the pressure which is settable at said spring.

4. An apparatus in accordance with claim 2, further wherein said other pressure switch has a spring loaded adjustment diaphragm which encloses a pressure chamber that communicates with said control line, said adjustment diaphragm arranged to enclose another chamber and adjustable to control the cross section of a supply line which communicates with a further chamber in a second pressure source which is correlated with a work chamber of a pressure-actuated servomotor.

5. An apparatus in accordance with claim 2, further wherein said other pressure switch is connected with a magnetic valve which is disposed in said one supply line, said pressure switch further arranged to control said adjustment medium traveling from a second pressure source to said work chamber of said servomotor.

6. An apparatus in accordance with claim 2, further wherein said exhaust recirculation control apparatus includes a plate valve arranged to open against said exhaust flow, said exhaust flow being connected with said hydraulic servomotor, which is acted upon by the adjustment pressure against the force of a return spring.

* * * * *